United States Patent [19]

Allen, deceased et al.

[11] Patent Number: 5,056,676

[45] Date of Patent: Oct. 15, 1991

[54] BOTTLE CAP FOR REPEATABLE AIRTIGHT SEALING

[76] Inventors: Herbert Allen, deceased, late of Houston; by Virginia D. Bedford, executrix, 5800 Lumberdale #64, Houston, both of Tex. 77092

[21] Appl. No.: 638,178

[22] Filed: Jan. 4, 1991

[51] Int. Cl.[5] ..... B65D 45/24

[52] U.S. Cl. ..... 215/284; 215/280; 215/287; 220/254; 220/233

[58] Field of Search ..... 215/284, 287, 280, 293, 215/354; 220/254, 234, 233, 262, 90.4

[56] References Cited

U.S. PATENT DOCUMENTS

| | | | |
|---|---|---|---|
| 1,644,457 | 10/1927 | Yancey | 215/287 |
| 1,681,036 | 8/1928 | Groby | 215/293 |
| 2,038,489 | 4/1936 | Guiot | 215/284 X |
| 2,170,531 | 8/1939 | Kahn | 215/280 X |
| 2,529,817 | 11/1950 | Russell | 220/254 X |
| 2,649,220 | 8/1953 | Vastano et al. . | |
| 2,966,277 | 12/1960 | Bean | 220/233 |
| 3,185,332 | 5/1965 | Greenstein . | |
| 3,317,071 | 5/1967 | Teeter . | |
| 4,009,794 | 3/1977 | Zapp | 215/210 |
| 4,190,173 | 2/1980 | Mason et al. | 220/203 |
| 4,567,994 | 2/1986 | Hofmann | 220/234 |
| 4,691,836 | 9/1987 | Wassilieff | 220/234 X |
| 4,770,307 | 9/1988 | Guglielmi . | |
| 4,942,976 | 7/1990 | Spencer | 220/254 |

OTHER PUBLICATIONS

Device "D"—2 photographs of prior art device.
Device "E"—3 photographs of prior art device.
Device "F"—3 photographs of prior art device.
Device "B"—3 photographs of prior art device.
Device "c"—2 photographs of prior art device..

*Primary Examiner*—Stephen Marcus
*Assistant Examiner*—Vanessa M. Roberts
*Attorney, Agent, or Firm*—Browning, Bushman, Anderson & Brookhart

[57] ABSTRACT

An improved bottle cap is provided for repeatedly obtaining airtight sealing engagement with a bottle having an annular external lip. The cap of the present invention is particularly well suited for sealing bottles containing sparkling wine or champagne, since such bottles conventionally include an external lip and since the cap of the present invention is able to seal gases within the bottle. The cap includes a housing having a central aperture for positioning over the neck of the bottle and having a radially inward directed flange for fitting beneath the external lip on the bottle. An activating carrier is movable within the aperture in the housing, and a ring-shaped pad holder and elastomeric pad are mounted on and are axially movable with respect to the carrier. A biasing spring is provided for acting on the holder and the pad to bias the pad toward sealing engagement with the bottle. A handle is rotatably secured to the housing, and includes a cam lobe for engaging the carrier and thereby energizing the spring to force the pad into sealing engagement with the bottle. An improved method is provided for fabricating a bottle cap for sealing engagement with a bottle having an annular external lip.

20 Claims, 1 Drawing Sheet

BOTTLE CAP FOR REPEATABLE AIRTIGHT SEALING

BACKGROUND OF INVENTION

1. Field of Invention

The present invention relates to a reusable bottle cap for obtaining airtight sealing engagement with a bottle. More particularly, the invention relates to a bottle cap which is highly reliable, easy to operate, and specifically designed for repeatable sealing engagement with various sparkling wine or champagne bottles, each having an annular external lip on the neck of the bottle.

2. Background of the Invention

Various reusable bottle caps have been devised and are commercially available. The least expensive of such caps may adequately seal liquid within a bottle, but over an extended period of time are not capable of retaining effervescence within a sparkling wine, champagne, or similar beverage. A preferred useable bottle cap is easy to operate, relatively inexpensive and, most importantly, is capable of sealing both a liquid and a gas within the bottle, such that a partially consumed beverage stored within its original bottle does not lose its taste.

Some reusable bottle caps are designed such that the sealing member fits within and seals against the generally cylindrical opening in the neck of the bottle. U.S. Pat. No. 3,317,017 discloses a bottle stopper with a generally cylindrical elastomeric seal which expands radially outward into sealing engagement with the internal walls of the bottle neck as the user lifts a knob to raise a piston upward with respect to the seal. Other types of reusable bottle caps employ a threaded mechanism or a lever to expand a seal radially outward into engagement with the interior cylindrical surface of the bottle neck. These devices generally do not possess the ability to retain a slightly pressurized gas within a bottle, and their sealing effectiveness is inherently dependent upon the diameter and surface finish of the interior surface of the bottle neck, which frequently varies with different bottle manufacturers.

Many bottles designed to contain a liquid with a gas over an extended period of time employ a ring-shaped exterior lip around the neck of the bottle. This lip is typically provided, for example, on bottles containing a sparkling wine or champagne. Those skilled in the art of bottle caps have recognized that this annular lip provides a convenient stop for enabling a bottle cap to engage the ring and allow an axially directed downward sealing force to be applied to seal a member with the upper annular surface of the bottle which defines the bottle opening.

U.S. Pat. No. 2,649,220 discloses a container closure having a lower skirt for engaging a radially outwardly protruding bead at the top of the bottle. When positioned on the bottle, a handle can be rotated to force a projection to drive a sealing disk into engagement with the top of the bottle. This device is relatively simple, but practically is designed for only one type of bottle. The device thus has limited utility, and does not suggest modifications which would enable the closure to be used with various bottles having varying axial dimensions between the top of the bottle and an annular projection on the neck of the bottle. U.S. Pat. No. 3,185,332 discloses a bottle cap with a tongue to fit under the bead on the bottle. A roller is provided for fitting under the bead on a radially opposite side of the bottle, and a locking handle retains the roller in place. This bottle cap again offers simplicity, but does not appear to be able to provide the desired sealing force to retain gases in various bottles over an extended period of time.

U.S. Pat. No. 4,770,307 discloses a bottle cap designed to operate in conjunction with an annular indented edge of the bottle below the bead. The device employs a sleeve arrangement to grip the bottle, and a spring to bias a washer into engagement with the top surface of the bottle. No mechanical advantage is available to activate the biasing spring which applies the sealing force. Accordingly, the user may lack the strength to depress the sleeve and overcome the biasing force of the spring to properly apply the cap. If the spring biasing force is minimized to facilitate application by the user, the biasing force may not be sufficient to seal gas within the bottle. Also, user cannot easily detect if the device is sealed to a bottle, since the device when merely placed over the bottle visually appears similar to the arrangement when the device is activated and sealed to the bottle.

Another prior art device employs a seal carried on the lower end of a threaded shaft which is mounted to a base member having a flange for underlying the drip ring of the bottle. The flange anchors the device with respect to the bottle so that the shaft may be threaded downward to bring the sealing member into engagement with the top surface of the bottle. Sealing effectiveness of this device depends upon the force which the user applies to the threaded shaft, and the shaft may undesirably unthread after the cap has been applied to the bottle. The user cannot easily detect if the device is merely positioned on the bottle, or whether the shaft has been torqued to bring the seal into engagement with the bottle. Another device utilizes a pair of pivoting arms to move inwardly and downwardly to engage the drip ring on the bottle. A sealing member is spring loaded to force the seal into engagement with the uppermost surface of the bottle. This device has the disadvantages of the device described in the '307 patent in that no mechanical advantage is available to increase the sealing effectiveness on the bottle. The user may thus not be able to apply the cap to some bottles, while the cap can be easily applied to other bottles but does not provide the desired axially directed force to obtain an effective seal.

The disadvantages of the prior art are overcome by the present invention, and an improved bottle cap is hereinafter described suitable for repeatedly sealing a bottle containing liquid in an airtight manner. Due to the high reliability yet simplicity of the device, the bottle cap of the present invention is particularly well suited for providing an airtight seal with a bottle containing a sparkling wine, champagne, or another effervescent liquid.

SUMMARY OF THE INVENTION

A cap is disclosed for repeatedly providing airtight sealing of a bottle, and particularly a bottle containing a sparkling wine or champagne having an annular external lip on the neck of the bottle. The cap of the present invention seals with an upper annular surface on the bottle which defines the bottle opening, and is designed for use with various bottles wherein the axial spacing between the external lip and the upper annular surface varies. The bottle cap of the present invention may thus be used for bottles having different size neck openings, and for bottles having substantially different configurations. The device is simple and relatively inexpensive, and can be easily used with a single hand.

The bottle cap comprises a housing for positioning on the neck of the bottle, the housing has a central opening therein for positioning over the neck of the bottle and for substantial alignment with the central axis of the bottle neck. A lower skirt is secured to the housing and has a radially inward directed flange for fitting beneath the annular external lip on the bottle. An activating carrier is axially movable within the central opening of the housing, and a handle rotatably secured to the housing includes a cam lobe for engagement with the upper surface of the actuating carrier to provide a substantial mechanical advantage to activate the device, and to lock the cap in a sealed position. A ring-shaped pad holder is positioned on and is axially removable with respect to the actuating carrier, and an elastomeric pad is secured to the ring-shaped holder. A biasing member is providing for acting between the actuating carrier and the pad holder to bias the pad axially toward the opening in the bottle. The handle cam surface provides the desired travel for the pad to enable the bottle cap to be used with bottles having different spacings between the external lip and the upper surface of the bottle.

During use, the cap is slid horizontally in place over the upper neck of the bottle so that the skirt flange fits under the annular external lip of the bottle and thereby limits upward movement of the bottle cap housing. The handle is then rotated so that the cam lobe drives the actuating carrier downward, thereby applying a substantial force to compress the biasing member and force the elastomeric pad into sealing engagement with the upper annular surface of the bottle which defines the bottle opening. The position of the handle allows the user to visually detect if the bottle cap is activated, and a flat on the handle cam also allows the user to feel when the cap is in its sealed position. The cap is removed by rotating the handle to its original position, and sliding the cap laterally off the bottle neck.

It is an object of the present invention to provide a reusable bottle cap which is easy to operate and can be reliably used with various bottles having a drip ring.

It is another object of this invention to provide a bottle cap which offers a substantial mechanical advantage for applying an axially directed force to seal with the bottle, yet can accommodate bottles having differing axial dimensions between the drip ring and the upper annular surface of the bottle which defines the opening in the bottle.

It is a feature of the present invention to provide a bottle cap with an actuating carrier which is axially movable within the central opening of a bottle cap housing, a ring-shaped pad holder positioned on and axially movable with respect to the actuating carrier, and an elastomeric pad secured to the ring-shaped holder.

It is another feature of the invention to provide an improved technique for fabricating a bottle cap adapted for repeatedly obtaining airtight sealing engagement with a bottle having an annular external lip.

A further feature of the invention is a bottle cap including an actuating carrier axially movable within a housing by rotating a handle, an elastomeric pad axially movable with respect to the actuating carrier for sealing engagement with the bottle, a primary spring for biasing the pad toward sealing engagement with the bottle when the handle is rotated to its sealed position, and a secondary return spring for biasing the carrier toward the handle when the handle is rotated to it unsealed position.

Yet another feature of the invention is that the elastomeric pad has a substantially frustroconical lower surface for enhancing alignment and improving sealing engagement with the upper annular surface of the bottle which defines the bottle opening.

Still a further feature of the invention is that the bottle cap is provided with a carrier which is axially movable within the bottle cap housing, but is continually in sliding engagement with the housing to guide the carrier during use of the bottle cap.

An advantage of the present invention is that it can be easily operated by relatively inexperienced personnel, and can be operated with a single hand.

A further advantage of the present invention is that one can easily detect when the bottle cap is merely positioned over the top of the bottle compared to when the bottle cap is activated for sealing engagement with the bottle.

These and further objects, features and advantages of the present invention will become apparent from the following detailed description, when reference is made to the figures in the accompanying drawings.

BRIEF DESCRIPTION OF THE PREFERRED EMBODIMENTS

Figure 1:
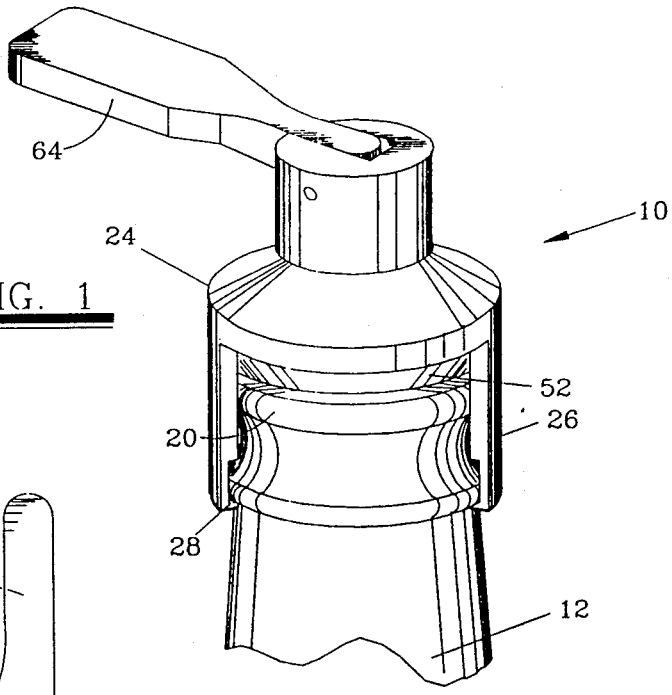
FIG. 1 is a pictorial view of a reusable bottle cap according to the present invention, illustrating the bottle cap according to the present invention in its sealed position on the neck of a champagne bottle.

FIG. 1 depicts one embodiment of reusable bottle cap 10 according to the present invention for airtight sealing engagement with a bottle 12. The cap 10 comprises a housing 24 including an integral lower skirt 26 having an inwardly directed flange 28 for fitting under the annular external lip or drip ring of the bottle 12, a handle 64 pivotally mounted to the housing, and an axially or longitudinally movable elastomeric pad 52 for sealing engagement with the ring-shaped mouth 20 on the bottle. This external drip ring design is commonly used for bottles containing sparkling wine or champagne, and the airtight seal of the bottle obtained by the elastomeric pad 52 makes the cap 10 particularly well suited for use with bottles containing gassy liquids. The cap of this invention thus not only prevents the liquid from leaking from the bottle, but more importantly prevents gases above the liquid from escaping, so that the gases entrained within the liquid do not continually escape to the sealed chamber between the liquid and the cap. The handle 64 not only provides a convenient mechanism for inputting a significant mechanical advantage to the downwardly directed force on the elastomeric pad for sealing engagement with the bottle, but also enables the user to easily detect if the cap is merely resting on top of the bottle or has been activated to its sealed position. The cap of the present invention can be easily installed on or removed from a bottle using a single hand, and high sealing reliability is obtained with a minimal amount of effort.

Figure 2:
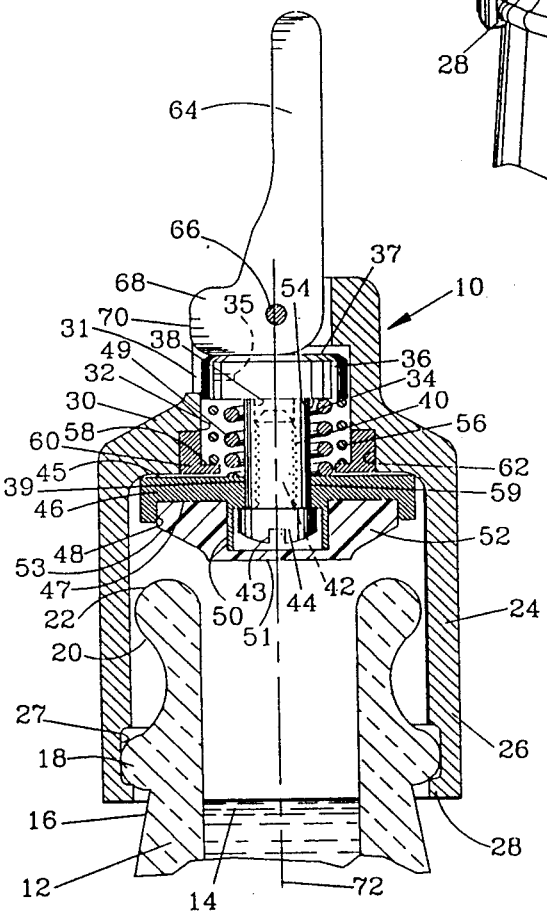
FIG. 2 is a side view, partially in cross-section, of the bottle cap generally shown in FIG. 1, and illustrating the bottle cap in its unsealed position applied on top of a champagne bottle.

Referring to FIG. 2, a representative bottle 12 is depicted containing a liquid 14. Only the neck portion 16 of the bottle is depicted, since the shape of the remaining portion of the bottle is not significant to the invention. Neck portion 16 includes an annular external lip or drip ring 18 common for sparkling wine or champagne bottles. The uppermost end of the bottle neck may contain a bead or lip which extends slightly outwardly to define a ring-shaped mouth 20, which has an external diameter less than the diameter of the drip ring 18. The cap of the present invention seals with the uppermost surface 22 on the bottle, which defines the opening for the bottle. The cap 10 has a central axis 72 which, when positioned on the bottle, is aligned with the central axis passing through the neck 16 of the bottle.

Figure 3:
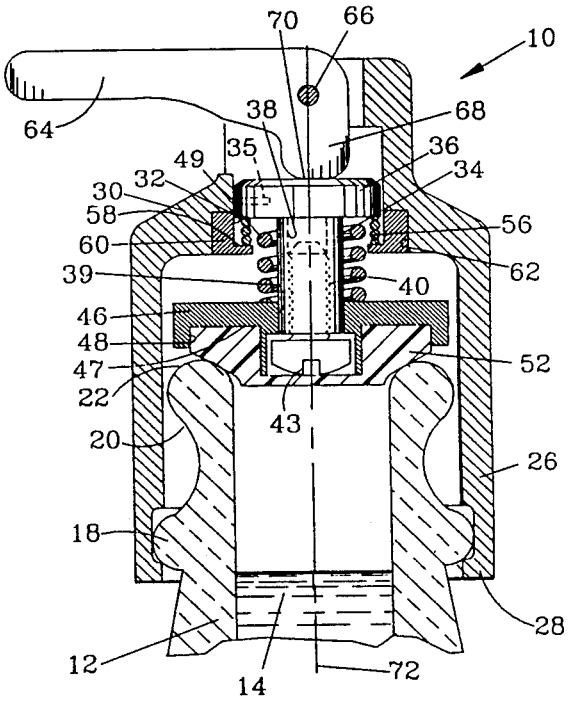
FIG. 3 is a side view, partially in cross-section, of the bottle cap shown in FIGS. 1 and 2, and illustrating the bottle cap handle in a position such that the bottle cap is sealed to the champagne bottle.

The cap 10 is shown in FIG. 2 positioned on but not activated for sealing engagement with the bottle. With the handle 64 positioned vertically, the cap 10 can be laterally slid over the top of the bottle so that the inwardly directed flange 28 is positioned under the drip ring 18. Thereafter, the user need only rotate the handle 64 downward to the position as shown in FIG. 3 to reliably seal the bottle cap 10 to the bottle 12. To subsequently remove the bottle cap, the user returns the handle to the upright position, and simply slides the cap laterally from the bottle.

The bottle cap housing 24 includes a lower skirt portion 26 having a general U-shaped cross-sectional configuration for sliding onto the neck of the bottle, and an upper portion 30 to which the handle 64 is pivotally connected. Skirt 26 includes a radially inwardly directed flange 28 which preferably extends around the perimeter of the skirt portion and serves to engage the drip ring 18. This flange 28 may be conveniently formed by cutting a groove 27 in the skirt portion for accommodating the outwardly directed drip ring. Upper portion 30 is a substantially sleeve-shaped member with a vertical groove 31 for accommodating rotation of the handle. The generally cylindrical interior wall 32 of upper portion 30 defines a central aperture in the housing an axis 72 substantially aligned with the central axis of the bottle neck.

An actuating carrier 34 is axially or vertically movable within the housing aperture, and includes a head portion 36 having an upper surface 37, and a sleeve-shaped downwardly projecting member 39 defining a cylindrical bore 38. A retainer 42 includes threads 40 for threading engagement with the carrier 34, and itself has a lower head portion 44 with a slot 43 or Phillips recess for receiving a screwdriver. A ring-shaped pad holder 46 is positioned on and is axially movable with respect to member 39, such that the cylindrical interior surface of 46 is in sliding engagement with the cylindrical exterior surface of 39. A downwardly projecting ring-shaped cavity is formed by the base surface 47, the exterior cylindrical surface 48, and the interior cylindrical surface 50 on the pad holder 46. Elastomeric pad 52 is press-fitted into this cavity for fixed engagement with the pad holder 46, and includes a central sheet portion 51 which extends between the perimeter portions of the pad. The elastomeric pad 52 further includes a generally frustoconical sealing surface 53 for sealing engagement with the upper surface 22 on the bottle.

Coil spring 49 is positioned about member 39 and engages the upper planar surface 45 of holder 46 and the lower planar surface 54 of head portion 36 for the carrier 34. Accordingly, the coil spring 49 provides a biasing force acting to move the pad holder 46 and thus the elastomeric pad 52 downward into engagement with the bottle. This biasing force may be minimal or nonexistent when the handle is in the vertical position as shown in FIG. 2, but increases substantially when the pad holder 46 moves axially toward the head 36, which occurs when the handle is rotated to the downward position as shown in FIG. 3.

A ring-shaped retainer 60 may be press-fitted into the cylindrical expansion in the cap housing 24 defined by surface 62, so that the installed retainer 60 is functionally integral with the housing. The retainer 60 includes a inwardly-directed ledge 58, and spring 56 thus acts effectively between the housing and the head 36 of the carrier 34 to bias the carrier in an upward position away from the neck of the bottle. When the handle 64 is positioned as shown in FIG. 2, the biasing force of coil spring 49 forces the holder 46 into engagement with the head 44 of retainer 42, while the upward force of coil spring 56 forces the upper surface 37 of carrier 34 into engagement with the handle 64 to lift the elastomeric pad 52 out of engagement with the bottle 12. The spring 56 thus allows the cap 10 to be easily slid horizontally on and off the neck of the bottle when the handle is rotated to its vertical position.

Pin 66 may be used to rotatably interconnect the handle 64 to the housing 24. The handle 64 includes a cam lobe 68 affixed thereto, with lobe 68 having a substantially planar locking surface 70. Referring to FIG. 3, it may be seen that when the handle 64 is rotated to its horizontal position, lobe 68 moves the carrier 34 axially downward, thereby forcing the elastomeric pad 52 into sealing engagement with the surface 22 on the bottle. During axial travel of the carrier 34, the cylindrical surface 32 of the housing continually guides the carrier to limit its travel in substantially the axial direction. This action compresses the main spring 49 as well as the return spring 56, although relatively little user force is necessary to rotate the handle 64 to the downward position because of the substantial mechanical advantage obtained by the handle and the cam lobe 68. With the handle rotated to the horizontal position as shown in FIG. 3, the substantially planar locking surface 70 of the cam lobe is in engagement with the upper surface 37 of the carrier, and accordingly there is little if any force tending to return the handle to its upright position.

It is a particular feature of this invention that the elastomeric pad 52 is biased into sealing engagement with the bottle by primary spring 49 or similar member which results in the elastomeric pad being axially movable with respect to the housing. This feature ensures that sufficient axially directed force will continually be applied to the pad to obtain the gas-tight seal when the axial dimension between the bottom of the drip ring 18 and the uppermost surface 22 of the bottle varies with different bottle manufacturers and bottle designs. If the user wished to use the cap 10 on a bottle substantially as shown in FIG. 3 except that the surface 22 were slightly above that depicted, the holder and pad 52 would simply slide further up the carrier 34 as the handle 64 were rotated downwardly. It is a related feature of the invention that the substantial axially directed sealing force applied by the spring 49 be energized or activated utilizing the mechanical advantage obtained by the handle 64 and cam lobe 68. In other words, if the surface 22 on the bottle were positioned axially further from the drip ring 18 than the design shown in FIGS. 2 and 3, the user may not be able to directly apply sufficient axial pressure to compress the spring 49 and the return spring 56 to a point so that it can be effectively locked in place. This mechanical advantage is easily obtained according to the present invention by the handle and the cam lobe, and the planar surface 70 on the cam lobe operates in conjunction with the carrier 34 to lock the cap in the sealing position as shown in FIG. 3.

When the handle 64 is positioned upward as shown in FIG. 2, a subassembly comprising the carrier 34, the pad holder 46, and the elastomeric pad 52 will be in its upward position so that the cap can be easily slid laterally onto the bottle. Coil spring 56 achieves this objective, and desirably has its strongest vertical force when the handle is rotated to its horizontal or sealed position and the subassembly is forced to its downward position. The primary spring 49 thus provide the sealing force to the pad and allows for variations in bottle dimensions and tolerances, while the smaller spring 56 provides an upward force to return the subassembly to its desired position when the handle 64 is raised to its unsealed or upward position. During movement of the handle, the carrier 34 is continually guided by the housing 24 so that its movement is limited to axially directed motion, and accordingly the movement of the pad holder 46 and the elastomeric pod 52 is similarly restricted to the direction along the axis 72. Since the lowermost surface of the drip ring 18 is typically sloped upward, the application of the axially directed downward force when the handle is moved horizontal tends to center the central axis 72 of the bottle cap with respect to the axis of the bottle neck, and accordingly the elastomeric pad is automatically centered for sealing engagement with the upper surface of the bottle.

It is a further feature of the invention that the sealing surface 53 of the pad 52 is substantially frustroconical in configuration. This design further ensures that the pad will be centered with respect to the axis of the bottle neck, and also results in both an axially directed downward and a radially directed outward force being applied by the pad to the bottle, which further contributes to the sealing effectiveness of the pad. The pad 52 is configured to encapsulate the head 44 of the retainer 42, so that fluid within the bottle is complete 14 sealed by the pad from the remaining components of the bottle cap 10.

During assembly of the bottle cap 10, the carrier 34 may be fitted within the cylindrical opening defined by surface 32 in the housing 24, the return spring 56 placed on the carrier, and the retainer 60 press-fitted to be fixed to the housing and compress the spring 56. The coil spring 49 and the holder 46 may then be fitted over the carrier, and the retainer 42 threaded to the carrier. In order to allow sufficient torque to be applied to the carrier by the retainer, the carrier may be rotated so that a small aperture 35 in head 36 is aligned with the slot 31, so that a conventional tool (not shown) may be fitted into aperture 35 and brought into engagement with the housing 24 to stop rotation of the carrier. Once the retainer has been fully threaded through the carrier, this tool may be removed, and pad 52 press-fitted to the holder. The handle 64 may then be secured to the housing with pin 66.

Various modifications may be made to the embodiment described in the foregoing drawings. The radially inward directed flange 28 on the skirt need not extend in a U-shaped manner along the entire perimeter of the skirt. Instead a plurality of flange tabs may project inwardly from the skirt for engagement with the drip ring of the bottle. Biasing members other than coil springs 49 and 56 may be used, although coil springs are preferred because of their low cost and high reliability. A primary biasing member 49 is required to accommodate bottles with differing dimensions between the external lip on the bottle and the upper sealing surface of the bottle. A secondary return biasing member 56 is preferred so that the carrier and pad will be automatically raised to allow easy insertion of the bottle cap on the bottle, although it may be possible to interconnect the handle and the carrier such that the carrier was raised by the handle other than by the return spring when the handle was rotated to its upward or unsealed position. Mechanisms other than a handle and cam lobe on the handle could be used for obtaining the desired mechanical advantage to energize the coil spring, although the design described herein is low cost and offers the further advantage of allowing the user to easily detect whether the cap is in sealing engagement with the bottle by observing the position of the handle with respect to cap housing. The elastomeric pad 52 may be fabricated from a natural or synthetic rubber, or other elastomeric material able to achieve repeatable sealing engagement with the upper surface of the bottle. The pad holder 46 provides a convenient means for mounting the pad on the carrier while allowing axial movement of the pad with respect to the carrier, and also allows the spring 49 to transmit the desired biasing force to the pad while ensuring that the spring does not damage the pad. Depending on the selected material for the pad, the holder may not be required, particularly if the composition of the pad could be affected so that its top surface and interior cylindrical surface which slidably engages the carrier could be more dense or less elastic than the frustroconical sealing surface of the pad. It should also be understood that the cap housing could be designed with a lower skirt having a radially inwardly directed flange for engaging the annular bead 20 on the bottle rather than the drip ring 18 on the bottle, and the term annular external lip on the neck of the bottle, as used herein, should be understood to include both the annular drip ring as shown in the drawings and the bead 20.

These and further modifications and changes may be made without departing from the spirit and scope of the invention. Such changes and modifications will, in fact, be suggested by the foregoing disclosure, and are considered within the scope of the invention, which is defined by the claimed appended hereto.

What is claimed is:

1. A bottle cap for repeatedly providing airtight sealing of a bottle having a neck and an annular external lip on the neck of the bottle and an upper annular surface defining an opening from the bottle, the opening having a central axis passing through the neck of the bottle, the bottle cap comprising:

a housing for positioning on the neck of the bottle and about the opening from the bottle, the housing having a central aperture therein for positioning above the opening from the bottle, the aperture having a center axis for substantial alignment with the central axis through the neck of the bottle;

a lower skirt fixedly secured to the housing and having a radially inwardly directed flange for fitting beneath and engaging the annular external lip on the bottle;

an actuating carrier axially movable within the central aperture in the housing and having an upper surface and downwardly projecting member;

a ring-shaped pad holder positioned on and axially movable with respect to the downwardly projecting member;

an elastomeric pad secured to the ring-shaped holder;

a biasing member for acting between the actuating carrier and the pad holder to bias the pad holder axially away from the upper surface on the actuating carrier and toward the opening from the bottle; and a handle rotatably secured to the housing and having a cam lobe affixed thereto for engaging the upper surface on the actuating carrier and moving the elastomeric pad into sealing engagement with the upper annular surface of the bottle.

2. The bottle cap as defined in claim 1, further comprising:

a return biasing member for acting between the housing and the actuating carrier to bias the actuating carrier toward the handle.

3. The bottle cap as defined in claim 1, further comprising:

the elastomeric pad having a substantially frustroconical lower surface for sealing engagement with the upper annular surface of the bottle.

4. The bottle cap as defined in claim 1, further comprising:

the central aperture in the housing defining a guide surface; and the actuating carrier having a radially outward surface for sliding engagement with the guide surface during rotational movement of the handle to limit movement of the actuating carrier with respect to the housing to substantially axially directed movement.

5. The bottle cap as defined in claim 1, further comprising:

a retainer fixedly secured to the actuating carrier for limiting axial movement of the pad holder with respect to the actuating carrier and thereby retaining the pad holder on the actuating carrier.

6. The bottle cap as defined in claim 5, further comprising:

the actuating carrier including a head portion defining the upper surface;

the downwardly projecting member of the actuating carrier having a substantially cylindrical bore; and the retainer having external threads for engagement within the cylindrical bore of the downwardly projecting member.

7. The bottle cap as defined in claim 2, wherein:

the biasing member is a primary coil spring; and the return biasing member is a secondary coil spring.

8. A cap for providing airtight sealing of a bottle having a neck and an external lip on the neck of the bottle and an upper surface defining an opening from the bottle, the opening from the bottle having a central axis passing through the neck of the bottle, the cap comprising:

a housing for positioning about the opening from the bottle, the housing having a central aperture therein for positioning above the aperture from the bottle, the opening having a center axis for substantial alignment with the central axis through the neck of the bottle;

a lower skirt secured to the housing and having a radially inward directed flange for fitting beneath the external lip on the bottle;

an actuating carrier axially movable within the central aperture in the housing;

an elastomeric pad supported on and axially movable with respect to the actuating carrier;

a biasing member for biasing the pad axially toward the opening from the bottle; and a control mechanism for increasing the manual force applied to the activating carrier and for moving the actuating carrier downward with respect to the housing and thereby energizing the biasing member to force the pad into sealing engagement with the bottle.

9. The cap as defined in claim 8, wherein the control mechanism comprises:

a handle rotatably secured to the housing; and a cam lobe affixed to the handle for energizing the actuating carrier and moving the pad into sealing engagement with the bottle.

10. The cap as defined in claim 8, further comprising:

a ring-shaped pad holder positioned on and axially movable with respect to the actuating carrier;

the elastomeric pad being secured to the ring-shaped holder; and the biasing member acts between the actuating carrier and the pad holder to bias the pad axially toward the opening from the bottle.

11. The cap as defined in claim 10, further comprising:

a retainer fixedly secured to the actuating carrier for limiting axial movement of the pad holder with respect to the actuating carrier and thereby retaining the pad holder on the actuating carrier.

12. The cap as defined in claim 8, further comprising:

a return biasing member for acting between the housing and the actuating carrier to bias the actuating carrier toward the handle.

13. The cap as defined in claim 8, further comprising:

the elastomeric pad having a substantially frustoconical lower surface for sealing engagement with the upper surface of the bottle.

14. The cap as defined in claim 8, further comprising:

the central aperture in the housing defining a guide surface; and the actuating carrier having a radially outward surface for sliding engagement with the guide surface during movement of the actuating carrier to limit movement of the actuating carrier with respect to the housing to substantially axially directed movement.

15. A cap as defined in claim 12, further comprising:

the biasing member is a primary coil spring; and the return biasing member is a secondary coil spring.

16. A method of fabricating a bottle cap adapted for sealing engagement with a bottle having an annular external lip on the neck of the bottle, the method comprising:

(a) forming a housing having an aperture therein with a central axis, the housing having a lower skirt for fitting about the neck of the bottle;

(b) providing an inwardly directed flange on the lower skirt for fitting under and engaging the annular external lip on the bottle;

(c) mounting an actuating carrier axially movable within the aperture in the housing and having a lower projecting member;

(d) positioning a ring-shaped pad holder on the lower projecting member of the actuating carrier and axially movable with respect to the actuating carrier;

(e) providing a biasing member between the actuating member and the pad holder for biasing the pad holder toward engagement with the bottle;

(f) securing an elastomeric pad on the pad holder for sealing engagement with the bottle; and (g) rotatably mounting a handle to the housing for engaging and moving the actuating carrier toward the bottle and thereby compressing the biasing member to bias the pad into sealing engagement with the bottle while allowing the pad to move axially with respect to the actuating carrier.

17. The method as defined in claim 16, further comprising:

biasing the actuating carrier toward the handle prior to performing step (d).

18. The method as defined in claim 16, further comprising:

securing a retainer to the actuating carrier to retain the pad holder on the actuating carrier after step (e) and prior to step (f).

19. The method as defined in claim 18, further comprising:

forming the elastomeric pad to seal the fluid within the bottle from remaining components of the bottle cap.

20. The method as defined in claim 16, further comprising:

the inwardly directed flange being fixed to the housing such that the housing is slid laterally on the bottle to engage the flange with the annular external lip on the neck of the bottle.

* * * * *